US011235963B2

(12) United States Patent
Dunigan

(10) Patent No.: US 11,235,963 B2
(45) Date of Patent: Feb. 1, 2022

(54) FORKS FOR INDUSTRIAL VEHICLES AND METHOD OF MAKING SAME

(71) Applicant: Hyster-Yale Group, Inc., Fairview, OR (US)

(72) Inventor: Robert C. Dunigan, Benson, NC (US)

(73) Assignee: HYSTER-YALE GROUP, INC., Fairview, OR (US)

( * ) Notice: Subject to any disclaimer, the term of this patent is extended or adjusted under 35 U.S.C. 154(b) by 329 days.

(21) Appl. No.: 16/197,893

(22) Filed: Nov. 21, 2018

(65) Prior Publication Data

US 2020/0156911 A1 May 21, 2020

(51) Int. Cl.
*B66F 9/12* (2006.01)

(52) U.S. Cl.
CPC ..... *B66F 9/12* (2013.01)

(58) Field of Classification Search
CPC ..... B66F 9/12; B66F 9/165; B66F 9/127
See application file for complete search history.

(56) References Cited

U.S. PATENT DOCUMENTS

| | | | | |
|---|---|---|---|---|
| 4,062,301 | A | 12/1977 | Pitchford | |
| 4,969,794 | A | 11/1990 | Larsen | |
| 5,014,487 | A | 5/1991 | King | |
| 5,752,584 | A * | 5/1998 | Magoto | B62B 3/06 187/231 |
| 5,934,544 | A | 8/1999 | Lee et al. | |
| 7,659,484 | B2 * | 2/2010 | Kroll | G01G 19/083 177/130 |
| 8,418,630 | B2 | 4/2013 | Strizki | |
| 2006/0181039 | A1 | 8/2006 | Fridlington | |
| 2015/0102274 | A1 | 4/2015 | He | |
| 2016/0122077 | A1 | 5/2016 | Moran | |
| 2018/0065653 | A1 | 3/2018 | Rusche et al. | |

FOREIGN PATENT DOCUMENTS

| | | |
|---|---|---|
| CN | 207330263 | 5/2018 |
| DE | 19503980 | 8/1996 |
| DE | 10321076 | 12/2004 |
| EP | 143290 | 6/1985 |
| EP | 562482 | 9/1993 |
| EP | 562484 | 9/1993 |
| EP | 1479643 | 11/2004 |
| EP | 1892213 | 2/2008 |
| FR | 1381775 | 1/1964 |
| GB | 1068761 | 5/1967 |
| GB | 1446510 | 8/1976 |
| IT | T020110032 | 7/2012 |

(Continued)

OTHER PUBLICATIONS

English Machine Translation of EP 1479643.*
European Patent Office; Extended European Search Report; EP App. No. 19204693.6; dated May 8, 2020; pp. 1-12.

*Primary Examiner* — Diem M Tran
(74) *Attorney, Agent, or Firm* — Schwabe Williamson & Wyatt

(57) ABSTRACT

A fork for an industrial vehicle such as a forklift, and a method of making the same. The fork includes an elongate body portion, a toe portion, and, optionally, a heel portion. The elongate body portion may be formed in any length and coupled to the toe portion (and optionally, to the heel portion) to form a fork.

21 Claims, 7 Drawing Sheets

(56) References Cited

FOREIGN PATENT DOCUMENTS

| | | | | |
|---|---|---|---|---|
| JP | H0713898 | | 3/1995 | |
| JP | 2004284744 | | 10/2004 | |
| WO | 1990003921 | | 4/1990 | |
| WO | WO-2012080755 | A1 * | 6/2012 | ..... B66F 9/12 |
| WO | WO-2020044064 | A2 * | 3/2020 | ..... B66F 9/085 |

* cited by examiner

FORKS FOR INDUSTRIAL VEHICLES AND METHOD OF MAKING SAME

TECHNICAL FIELD

This application relates to forked vehicles configured to transport goods and materials, for example on a pallet.

BACKGROUND

Typical pallet trucks support one, two in-line, or three in-line standard size pallets. Typically, pallet trucks include lifting load forks that are welded at their rear end or heel end to a frame and/or battery box. The front end of the forks typically includes support rollers. A hydraulic system operates a lifting mechanism that moves the support rollers, and lifts the battery box and the forks together with goods, such as pallets loaded thereon. The support rollers are typically coupled to the lift mechanism, for example with a linkage that transmits the force from a hydraulic lifting cylinder to the support rollers. A valve arrangement is provided to relieve the hydraulic pressure in the lifting cylinder, thus lowering and placing the load on the floor. Steer wheels are located behind the battery box. A steering mechanism, such as a tiller, also may be provided to steer the steer wheels relative to the battery box and forks.

DETAILED DESCRIPTION

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of the invention is defined by the appended claims.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous.

Figure 1:
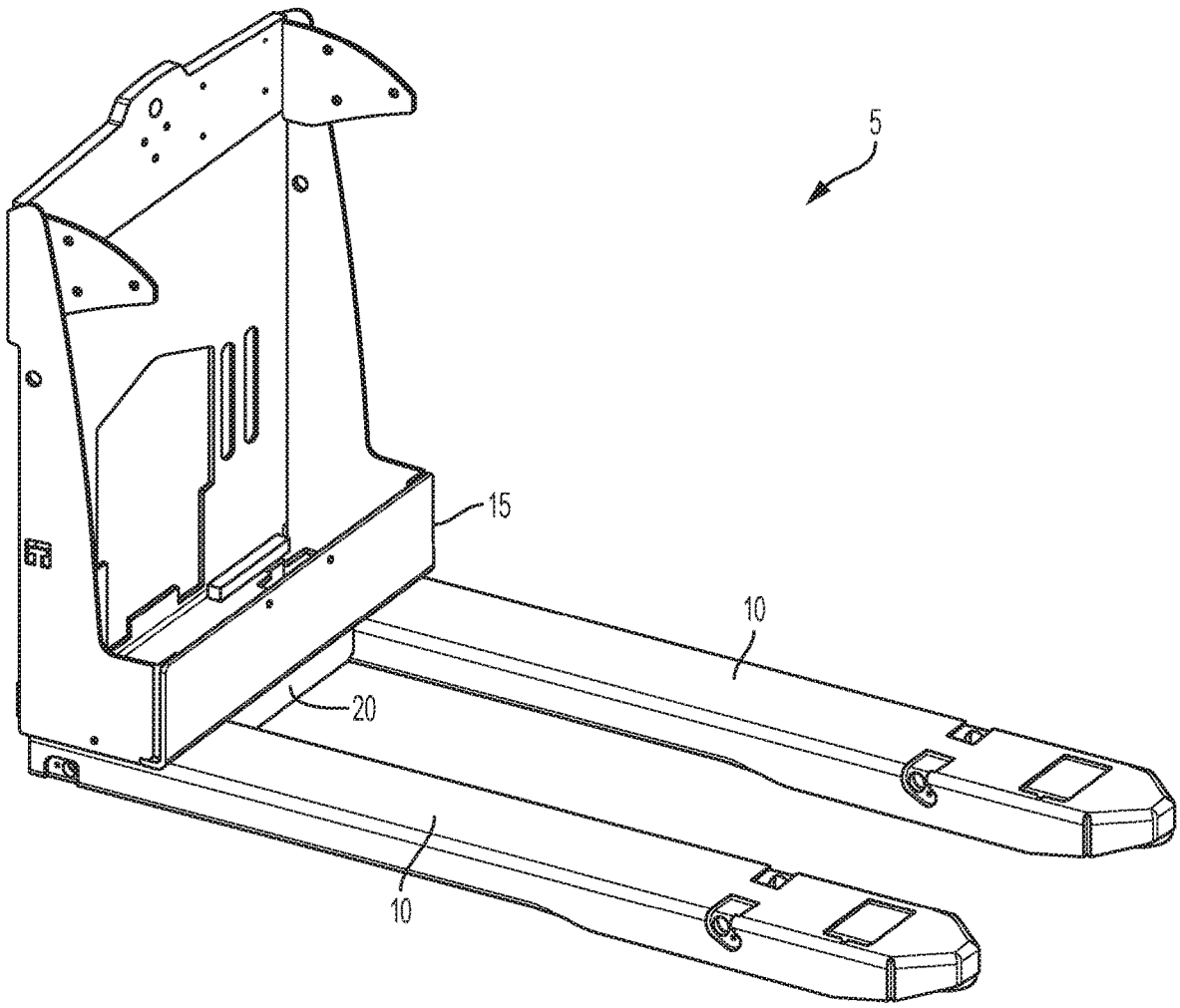
FIG. 1 PRIOR ART
FIG. 1 illustrates a front left isometric view of a prior art fork assembly, showing a pair of forks welded to the battery box.

FIG. 1 illustrates a front left isometric view of a prior art battery box and fork assembly 5 showing a pair of forks 10 welded to the battery box 15. As is typical with conventional pallet trucks, each of the forks 10 is made of multiple components that are welded into a unitary structure that is welded to the battery box 15 and to a torsion tube 20.

One challenge faced by pallet truck manufacturers is that customers often need varying fork configurations, such as forks with variable spreads, lengths, tips, and widths. Because forks are typically manufactured in standard sizes, changing fork parameters requires costly and time-consuming retooling to modify the battery box and/or fork design to produce a pallet truck conforming to individual customer specifications. In some situations, such redesigns can add up to six weeks of lead-time. In addition, stocking multiple lengths of forks may require a significant capital outlay for inventory.

To overcome the aforementioned problems and others, the inventors have developed a fork that includes an elongate body portion that couples directly or indirectly to the battery box at a first end, and to a toe portion (also referred to as a fork tip) at the second (opposite) end. Thus, the elongate body portion may be made in any desired length, welded or locked to the battery box, and coupled to a desired fork tip to create a customizable system that accommodates a wide range of customer preferences. The elongate body portion is formed such that thinner and/or lighter materials may be used compared to existing fork bodies while providing dimensional stability and reducing materials costs and/or weight. Additionally, manufacturing processes that avoid the need to assemble multiple parts together may be used, for example, roll forming, additive manufacturing, or extrusion processes. The optional use of such processes to form the elongate body portion reduces the assembly and welding costs typically associated with conventional fork manufacture. These and other features provide a competitive advantage and differentiator in an exceedingly crowded market.

Figure 2:
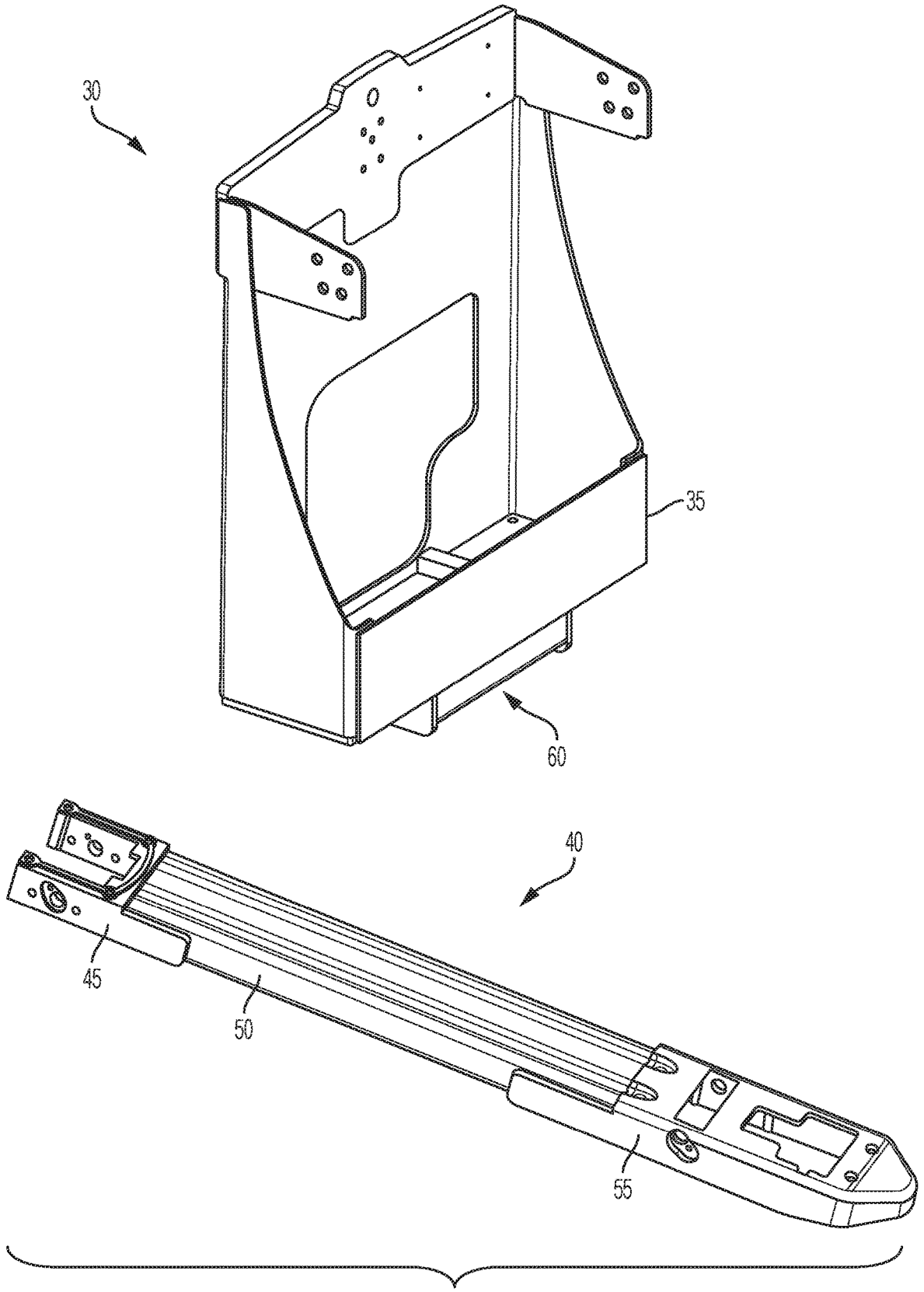
FIG. 2 illustrates a front left isometric view of an example battery box and fork showing the fork disassembled from the battery box.

FIG. 2 illustrates a front left isometric view of an example of a battery box and fork showing the fork disassembled from the battery box. The battery box and fork assembly 30 includes a battery box 35 and two forks 40, though only one fork 40 is shown in FIG. 2. The forks 40 may couple to the battery box 35 by welding or by locking. Locking a fork to a battery box 35, torsion member 60, or both, means that the fork can also be unlocked from the battery box 35, torsion member 60, or both. The battery box 35 is sized to fit a battery or battery array. When used in conjunction with a pallet truck, pallet jack, or other suitable forklift, the entire battery box and fork assembly 30 may be raised and lowered as a single unit, for example via a hydraulic cylinder.

The two forks 40 may be referred to as a right fork and left fork, respectively, depending on what side of the battery box 35 they are coupled to. In some embodiments, the right and left forks 40 are identical such that one fork 40 may be swapped for the other. Each fork 40 includes several portions. The fully assembled fork 40 includes an optional heel portion 45, an elongate body portion 50, and a toe portion 55 (also referred to as a fork tip). For convenience and modularity, the optional heel portion 45, the elongate body portion 50, and the toe portion 55 may be identical for both the left and right forks (e.g., the forks coupled to the left and right sides of the battery box 35). Using identical components for both the left and right forks 40 increases the modularity of the system over a system in which the left and right forks are made with distinct, non-interchangeable components. However, distinct, non-interchangeable components may be used to create left and right forks in certain embodiments. The optional heel portion 45 and the toe portion 55 are connected to the elongate body portion 50, for example, by welding or other suitable attachment. With respect to the fork 40, the heel end (also referred to as the proximal end) is the end closest to the battery box 35, and may include an optional heel portion 45. In the illustrated embodiment, the heel end of the fork 40 is coupled to a heel portion 45 that is configured to be locked to the battery box 35 and torsion member 60, however in other embodiments the heel end of the fork 40 may be welded or otherwise coupled directly to the battery box 35 and torsion member 60 with or without employing a separate heel portion. The toe end (also referred to as the distal end) is the opposite end, furthest from the battery box 35, that initially engages a pallet when picking up a load.

Figure 3:
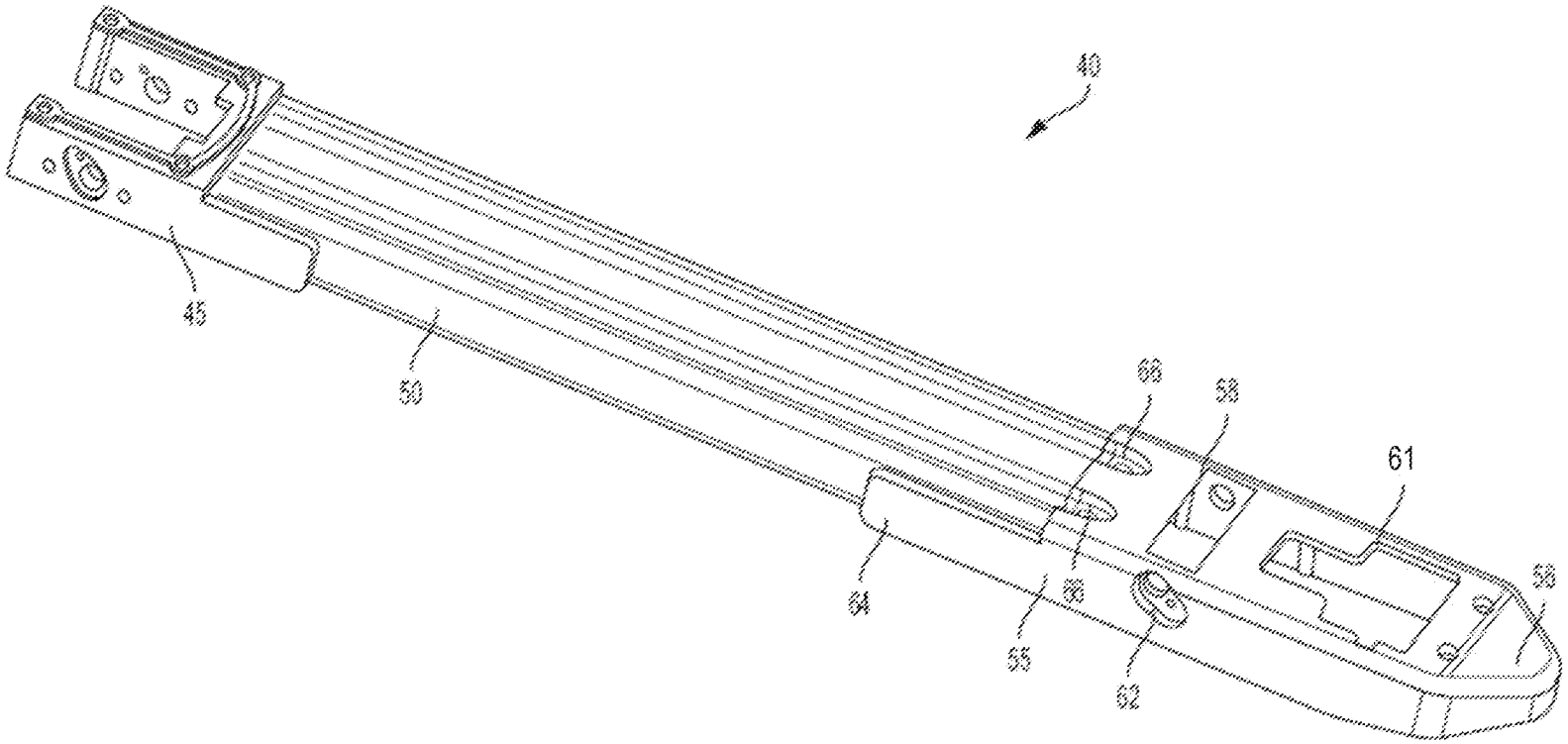
FIG. 3 illustrates a front left isometric view of the fork shown in FIG. 2.
Figure 4:
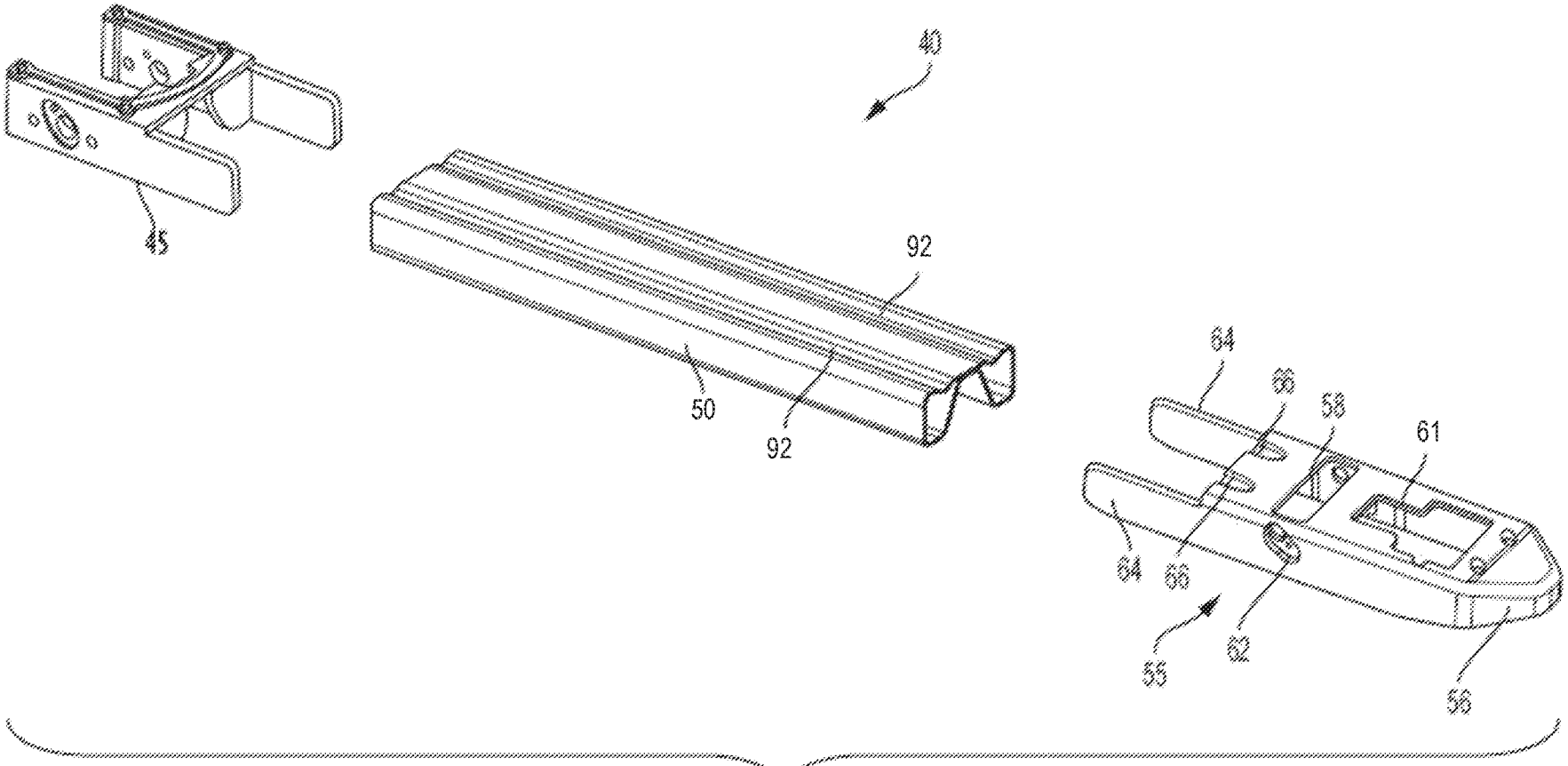
FIG. 4 illustrates a front left exploded view of the fork shown in FIG. 2.

FIGS. 3 and 4 illustrate front right isometric views of the fork of FIG. 2 as assembled (FIG. 3) and exploded (FIG. 4), respectively. The illustrated fork 40 includes an optional heel portion 45, which may be cast or machined from a solid metal billet as a solid unitary body. The optional heel portion 45 may be used in embodiments where it is desirable to removably couple the fork 40 to the battery box and torsion bar, such as by locking. In such embodiments, the machined surface of the optional heel portion 45 provides the tight tolerances needed to achieve a close fit between the optional heel portion 45 and the battery box and torsion bar without welding. In embodiments wherein the fork 40 is coupled to the battery box and torsion bar by welding, the optional heel portion 45 may not be needed, and may be omitted to reduce the cost of the battery box and fork assembly.

The illustrated fork 40 also includes a toe portion 55 that is sized and shaped to couple to the elongate body portion 50 of the fork 40. Like the optional heel portion 45, the toe portion 55 also may be machined or cast, for example as a unitary body. The toe portion 55 can take any of a number of different forms tailored for specific applications and customer preferences, and generally includes a tip 56 that is sized and shaped to engage and slide into the openings of a pallet. Support roller cut outs 58, 61 and attachment sites 62 are provided to accommodate the support wheel mechanism. Side rails 64 may be provided that extend proximally along the side surfaces of the elongate body portion 50 to provide a location for welding or otherwise coupling the elongate body portion 50 and the toe portion 55. Additional mating features, such as pockets 66 may be provided to form a secure fit and welding site between the elongate body portion 50 and the toe portion 55.

Figure 5:
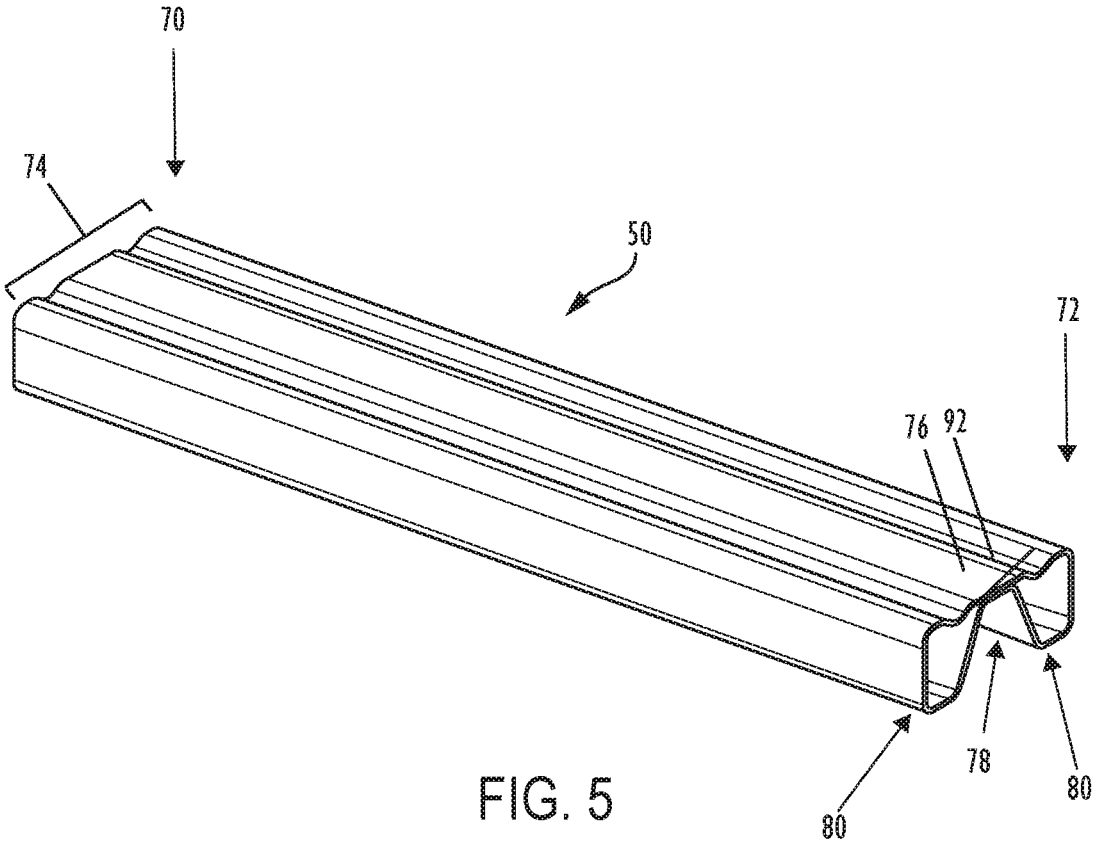
FIG. 5 illustrates a front left isometric view of an example of a fork body.
Figure 6:
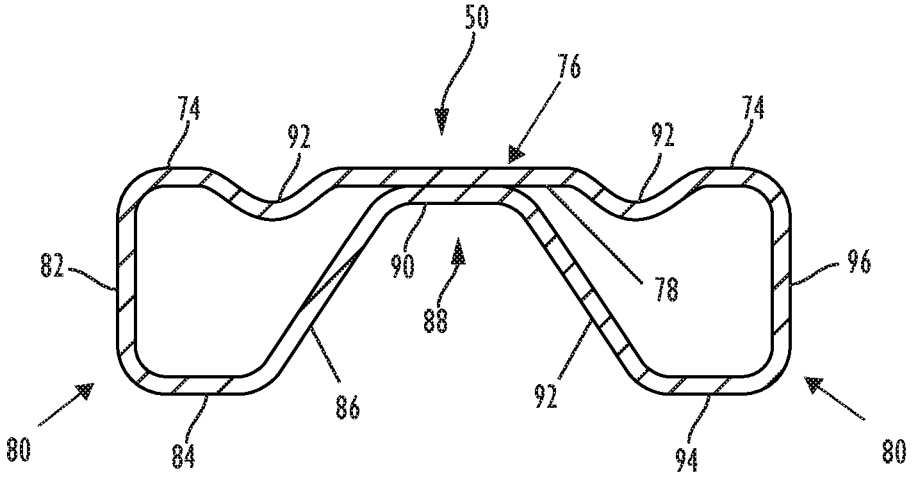
FIG. 6 illustrates a cross-sectional view of the elongate body portion of FIG. 6.

FIGS. 5 and 6 illustrate a front left isometric view (FIG. 5) and a cross-sectional view (FIG. 6) of an example of an elongate body portion 50. Conventional forks typically include a flat or substantially flat upper load-bearing surface, with various reinforcing structures, such as perpendicularly-oriented sides and bracing members welded to the underside to provide resistance to bending and torsion. These supporting structures often are continuous with other fork features, such as tapered tip structures and retention features for the support wheels and linkage mechanism, and as such, require the labor of a highly skilled welder, or complex robotic welding equipment, to assemble the forks from many pieces.

By contrast, the disclosed elongate body portions 50 may be formed using a process, such as cold rolling, additive manufacturing, or extrusion processes such that they may be made in any length to suit customer-specific specifications. Additionally, using such optional manufacturing processes, the disclosed elongate body portions may be made with minimal weldments, such as a single longitudinal weldment (in the case of rolled steel) or no weldments (in the case of additive manufacturing or extruded materials), which reduces labor costs and waste material associated with manufacturing commonly available fork bodies. In some embodiments, an elongate body portion may include a plurality of longitudinal weldments, such as no more than two longitudinal weldments, a single longitudinal weldment, or no longitudinal weldments. As used herein, the term "longitudinal weldment" is used to refer to a weldment that extends along all or most of the length of an elongate body portion, such as may be used to join a first edge of a sheet of steel to another portion of the sheet of steel, such as a second edge of the sheet of steel. Longitudinal weldments also may be used to secure other portions of the steel sheet to one another.

Figure 8:
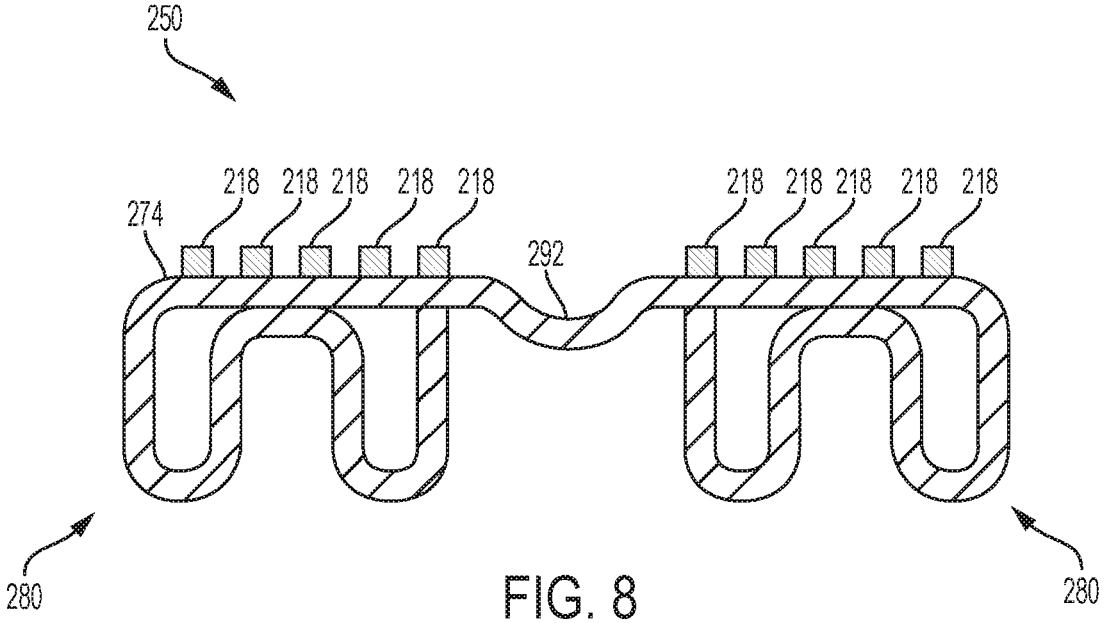
FIG. 8 illustrates a cross-sectional view of another example of an elongate body portion.

In the illustrated embodiment, the elongate body portion 50 includes a first end 70 configured to be coupled to a heel portion or battery box, a second end 72 configured to couple to a toe portion, and a first load-bearing member 74 extending longitudinally from the first end 70 to the second end 72. The load-bearing member 74 comprises one or more flat surfaces 76 and is coupled to a truss 80 as discussed below. In some embodiments, the flat surfaces 76 are rigidly connected to one or more stiffeners, for example, flutes 92. Stiffeners may be integrally formed with the flat surfaces 76 to accomplish a rigid connection, or may be welded or otherwise suitably secured to the flat surfaces. Stiffeners 92 provide resistance against longitudinal bending of the flat surfaces, such as flat surfaces 76. Alternate stiffeners include inverted flutes 92, fins 218 (see, e.g., FIG. 8), and other suitable structures that inhibit longitudinal bending of the flat surfaces. Stiffeners 92 may protrude above the flat surfaces, for example as illustrated in FIG. 8, or may protrude below the flat surfaces, for example, as illustrated in FIGS. 5 and 6, or may be formed within the flat surfaces.

An exemplary truss 80 coupled to the load-bearing member 74 is described with reference to FIGS. 5 and 6. The truss 80 forms a structural element that resists one or more of flex, torsion, axial compression, and/or lateral deflection of the load-bearing portion. The truss 80 includes a first strut 82 that extends downward from the outer edge of the load-bearing member 74 in a generally orthogonal orientation with respect to the load-bearing member 74. A first cross beam 84 is coupled to the first strut 82 and extends away from the first strut 82, for example, substantially orthogonally from the first strut 82 (toward the midline of the elongate body portion 50) to form a lower surface of the body portion 50. A second strut 86 is coupled to the first cross beam 84 and extends from the first cross beam 84 towards the load-bearing member 74. The second strut 86 may be non-perpendicular (e.g., positioned in a diagonal plane) with respect to the load-bearing member 74 to enhance the stiffness and torsion-resistance of the body portion 50.

An optional second cross beam 90 is coupled to the second strut 86 and contacts the lower surface 78 of the load-bearing member 74. The second cross beam 90 is coupled to the load-bearing member 74, for example, via spot welds or by being integrally formed with the load-bearing member. A third strut 92 is coupled to the second cross beam 90 and extends from the second cross beam 90 away from the load-bearing member 74. The third strut 92 may be non-perpendicular (e.g., positioned in a diagonal plane) with respect to the load-bearing member 74 to enhance the stiffness and torsion-resistance of the body portion 50. A third cross beam 94 is coupled to the third strut 92 and extends away from the third strut 92 (away from the midline of the body portion 50) to form a lower surface of the body portion 50. A fourth strut 96 extends from the third cross beam 94 towards the load-bearing member 74 and is coupled to the other outer edge of the load-bearing member 74.

In some embodiments, the truss 80 may be coupled to the load-bearing member 74 via welding. In other embodiments, the truss member may be integrally formed with the load-bearing member 74. In yet other embodiments, the truss member may be partially integrally formed with the load-bearing member 74 and secured to the load-bearing member 74 via welding or other suitable attachment, for example, via a single longitudinal weldment joining the fourth strut 96 to the load-bearing member 74. Likewise, elements of the truss 80 may be integrally formed together, may be welded or otherwise suitably attached together, or may be coupled via a combination of integral formation and attachment such as welding.

The truss 80 structure described above creates left and right portions of the truss 80 that are spaced apart to form a central channel 88 on the underside of the fork that is sized and shaped to receive a support wheel linkage mechanism. In some embodiments, the elongate body portion 50 also includes the second cross beam 90, which may act as a second load-bearing member extending between the left and right portions of truss 80. This second cross beam 90 may be substantially parallel to the first load-bearing member 74, and may contact and/or be secured to or formed as part of the lower surface 78 of the first load-bearing member 74. Coupling the first load-bearing member 74 to the second cross beam 90, or forming them together, may reduce the tendency of the first load-bearing member 74 and the second cross beam 90 to slide with respect to one another when placed under load. In some embodiments, the first load-bearing member 74 also may include one or more longitudinal flutes or fins, such as stiffeners 92, to further increase rigidity and resistance to bending and torsion.

Forming the elongate body portion 50 in this fashion increases the rigidity and torsion-resistance of the fork sufficiently that the elongate body portion 50 may be formed from lighter and/or thinner materials compared to conventional forks, which can provide savings in terms of materials cost and/or increase the efficiency and performance of the pallet truck. For example, a conventional steel fork has a sidewall thickness dimension of about 6 mm, whereas the present elongate body portion can use a thinner steel sheet, such as 5.0 mm, 4.9 mm, 4.8 mm, 4.7 mm, 4.6 mm, 4.5 mm, or even thinner steel without sacrificing structural integrity. Other materials, such as polymer materials, may provide other advantages, and can be selected on the basis of weight, bending resistance, breaking resistance, torsional resistance, or other suitable factor. The weight reduction resulting from the disclosed features may permit a pallet truck equipped with the disclosed forks to operate longer on the same amount of fuel, resulting in cost savings.

Table 1 illustrates a number of functional characteristics of one example of a fork as disclosed herein compared to a conventional fork. The fork was made from steel and had a sidewall thickness of 4.5 mm, and the conventional fork was made of steel and had a sidewall thickness of 6.0 mm. Under a load of 2,500 or 5,000 pounds, the fork exhibited less bending, torsion, and transverse displacement compared to a conventional fork.

TABLE 1

Comparison of Functional Characteristics
Conventional Fork (6.0 mm sidewall thickness) vs.
New Fork (4.5 mm sidewall thickness)

| Load = 2,500 lbs. | | | | | | |
|---|---|---|---|---|---|---|
| | Overall | Bending | | | | |
| | length | Y Disp. | Stiffness | | Compare % | |
| Model | (mm) | (in.) | (Load/Y) | Weight | Stiffness | Weight |
| Conventional | 1099 | 0.0045 | 5.62E+05 | 43.5 | | |
| New | 1120 | 0.0009 | 2.69E+06 | 48.3 | 79.1% | 10% |

| Moment (in./lb = 5000) | | | | |
|---|---|---|---|---|
| | Overall | Twisting | | |
| Model | Length (mm) | Y Disp. (in.) | Stiffness (M/Y) | Compare % Stiffness |
| Conventional | 1099 | 1.56E−1 | 1.6+04 | |
| New | 1120 | 2.12E−02 | 1.18E+05 | 86.4% |

TABLE 1-continued

Comparison of Functional Characteristics
Conventional Fork (6.0 mm sidewall thickness) vs.
New Fork (4.5 mm sidewall thickness)

Load (in./lb = 1500)

| Model | Overall Length (mm) | Transverse Z Disp. (in.) | Transverse Stiffness (Load/Z) | Compare % Stiffness |
|---|---|---|---|---|
| Conventional | 1099 | 0.1571 | 1.59+04 | |
| new | 1120 | 8.72EE−03 | 2.87E+05 | 94.4% |

Figure 7:
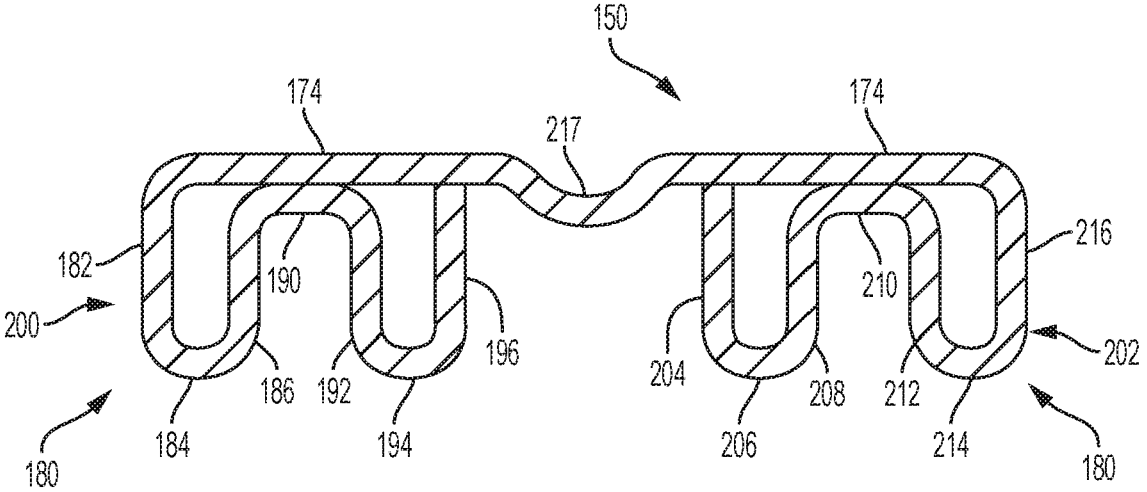
FIG. 7 illustrates a cross-sectional view of another example of an elongate body portion.

Another exemplary truss portion 180 coupled to a load-bearing member 174 is described with reference to FIG. 7. The truss portion 180 forms a structural element that resists one or more of flex, torsion, axial compression, and/or lateral deflection of the load-bearing portion. The truss portion 180 includes a first truss 200 and a second truss 202. The first truss 200 includes a first strut 182 that is coupled to and extends downward from the outer edge of the load-bearing member 174 in a generally orthogonal orientation with respect to the load-bearing member 174. A first cross beam 184 is coupled to the first strut 182 and extends away from the first strut 182, for example, substantially orthogonally from the first strut 182 (toward the midline of the elongate body portion 150) to form a lower surface of the elongated body portion 150. A second strut 186 is coupled to the first cross beam 184 and extends from the first cross beam 184 towards the load-bearing member 174.

A second cross beam 190 is coupled to the second strut 186 and contacts the lower surface of the load-bearing member 174. The second cross beam 190 is optionally coupled to the load-bearing member 174, for example, via spot welds or by being integrally formed with the load-bearing member. A third strut 192 is coupled to the second cross beam 190 and extends from the second cross beam 190 away from the load-bearing member. In other embodiments, the second cross beam 190 may be omitted, and a second strut, such as second strut 186, and a third strut, such as third strut 192, may be coupled to a load-bearing member, such as load-bearing member 174. A third cross beam 194 is coupled to the third strut 192 and extends away from the third strut 192 (toward the midline of the body portion 150) to form a lower surface of the body portion 150. A fourth strut 196 extends from the third cross beam 194 towards the load-bearing member 174 and is coupled to the load-bearing member 174.

The second truss comprises a fifth strut 204 that is coupled to and extends downward from the load-bearing member 174. A fourth cross beam 206 is coupled to the fifth strut 204 and extends away from the fifth strut 204, for example, substantially orthogonally from the fifth strut 204 (away from the midline of the elongate body portion 150) to form a lower surface of the elongated body portion 150. A sixth strut 208 is coupled to the fourth cross beam 206 and extends from the fourth cross beam 208 towards the load-bearing member 174.

A fifth cross beam 210 is coupled to the sixth strut 208 and contacts the lower surface of the load-bearing member 174. The fifth cross beam 210 is optionally coupled to the load-bearing member 174, for example, via spot welds or by being integrally formed with the load-bearing member. A seventh strut 212 is coupled to the fifth cross beam 210 and extends from the fifth cross beam 210 away from the load-bearing member 174. In other embodiments, the fifth cross beam 210 may be omitted, and a sixth strut, such as sixth strut 208, and a seventh strut, such as seventh strut 212, may be coupled to a load-bearing member, such as load-bearing member 174. A sixth cross beam 214 is coupled to the seventh strut 212 and extends away from the seventh strut 212 (away from the midline of the body portion 150) to form a lower surface of the body portion 150. An eighth strut 216 extends from the sixth cross beam 214 towards the load-bearing member 174 and is coupled to the load-bearing member 174.

An optional stiffening element may be coupled to or formed in the load-bearing member 174. For example, a longitudinal flute 217 may be formed in the load-bearing member 174 to provide resistance against longitudinal bending of the body portion 150.

FIG. 8 illustrates another exemplary elongated body portion 250. The description of truss portion 180 applies to truss portion 280. As illustrated in FIG. 8, the load bearing member 274 may include more than one type of stiffeners, such as a flute 292 that extends toward the truss portion 280, and a plurality of fins 218 that extend away from the truss portion 280. In the illustrated example, the plurality of fins 218 may serve to form the upper-most surface of the load bearing member 274, and may support a load, such as a pallet, thereupon.

Also disclosed herein in various embodiments are methods of making an elongate body portion for a fork. One method includes using a cold rolling process to form a steel sheet into an elongate body portion that includes a first end, a second end configured to couple to a toe portion, a load-bearing member having an upper surface and a lower surface and extending longitudinally from the first end to the second end, and a truss extending downward from the outer edges of the load-bearing member. The truss includes a first strut that extends downward from and generally orthogonally to the first load-bearing member. A first cross beam is coupled to the first strut and extends away from the first strut, for example, substantially orthogonally from the first strut (toward the midline of the elongate body portion) to form a lower surface of the body portion. A second strut is coupled to the first cross beam and extends from the first cross beam towards the load-bearing member. The second strut may be non-perpendicular (e.g., positioned in a diagonal plane) with respect to the load-bearing member to enhance the stiffness and torsion-resistance of the body portion.

A second cross beam is coupled to the second strut and contacts the lower surface of the load-bearing member. The second cross beam is coupled to the load-bearing member, for example, via spot welds. A third strut is coupled to the second cross beam and extends from the second cross beam away from the load-bearing member. The third strut may be non-perpendicular (e.g., positioned in a diagonal plane) with respect to the load-bearing member to enhance the stiffness and torsion-resistance of the body portion. A third cross beam is coupled to the third strut and extends away from the third strut (away from the midline of the body portion) to form a lower surface of the body portion. A fourth strut extends from the third cross beam towards the load-bearing member and is coupled to the other outer edge of the load-bearing member.

In some embodiments, the elongate body portion may include no more than two longitudinal weldments, or no more than one longitudinal weldment. In some embodiments, the method further includes forming a longitudinal weldment to join the first longitudinal edge and the second longitudinal edge of the steel sheet, and in particular embodiments, the longitudinal weldment may extend the full length of the elongate body portion. The truss may include two portions that are spaced apart to form a central channel sized and shaped to receive a support wheel linkage mechanism.

Another method includes using an extrusion process to form an elongate body portion that includes a first end, a second end configured to couple to a toe portion, a load-bearing member having an upper surface and a lower surface and extending longitudinally from the first end to the second end, and a truss extending downward from the outer edges of the load-bearing member. The truss includes a first strut that extends downward from and generally orthogonally to the first load-bearing member. A first cross beam is coupled to the first strut and extends away from the first strut, for example, substantially orthogonally from the first strut (toward the midline of the elongate body portion) to form a lower surface of the body portion. A second strut is coupled to the first cross beam and extends from the first cross beam towards the load-bearing member. The second strut may be non-perpendicular (e.g., positioned in a diagonal plane) with respect to the load-bearing member to enhance the stiffness and torsion-resistance of the body portion.

A second cross beam is coupled to the second strut and contacts the lower surface of the load-bearing member and/or is continuous and/or is integrally formed with the load-bearing member. A third strut is coupled to the second cross beam and extends from the second cross beam away from the load-bearing member. The third strut may be non-perpendicular (e.g., positioned in a diagonal plane) with respect to the load-bearing member to enhance the stiffness and torsion-resistance of the body portion. A third cross beam is coupled to the third strut and extends away from the third strut (away from the midline of the body portion) to form a lower surface of the body portion. A fourth strut extends from the third cross beam towards the load-bearing member and is coupled to the other outer edge of the load-bearing member. The truss may include two portions that are spaced apart to form a central channel sized and shaped to receive a support wheel linkage mechanism.

Also disclosed are methods of making a fork. Such methods include providing a toe portion and an elongate body portion, the elongate body portion including a first end, a second end configured to couple to a toe portion, a load-bearing member having an upper surface and a lower surface and extending longitudinally from the first end to the second end, and a truss extending downward from the outer edges of the load-bearing member. The truss includes a first strut that extends downward from and generally orthogonally to the first load-bearing member. A first cross beam is coupled to the first strut and extends away from the first strut, for example, substantially orthogonally from the first strut (toward the midline of the elongate body portion) to form a lower surface of the body portion. A second strut is coupled to the first cross beam and extends from the first cross beam towards the load-bearing member. The second strut may be non-perpendicular (e.g., positioned in a diagonal plane) with respect to the load-bearing member to enhance the stiffness and torsion-resistance of the body portion.

A second cross beam is coupled to the second strut and contacts the lower surface of the load-bearing member and/or is continuous and/or is integrally formed with the load-bearing member. A third strut is coupled to the second cross beam and extends from the second cross beam away from the load-bearing member. The third strut may be non-perpendicular (e.g., positioned in a diagonal plane) with respect to the load-bearing member to enhance the stiffness and torsion-resistance of the body portion. A third cross beam is coupled to the third strut and extends away from the third strut (away from the midline of the body portion) to form a lower surface of the body portion. A fourth strut extends from the third cross beam towards the load-bearing member and is coupled to the other outer edge of the load-bearing member. The truss may include two portions that are spaced apart to form a central channel sized and shaped to receive a support wheel linkage mechanism. The method further includes coupling the toe portion to the second end of the elongate body portion. In some embodiments, the method also includes providing a heel portion, and coupling the heel portion to the first end of the elongate body portion.

While some of the examples have been illustrated or described with respect to providing functionality for a "walkie" or "rider" style pallet truck, some or all of the features may also be enabled for operation with other types of industrial vehicles including, but not limited to, reach trucks, three-wheel stand trucks, warehouse trucks, and counterbalanced trucks.

Having described and illustrated various examples herein, it should be apparent that other examples may be modified in arrangement and detail. We claim all modifications and variations coming within the spirit and scope of the following claims.

I claim:

1. A fork for a forklift truck comprising:

a toe portion; and an elongate body portion coupled to the toe portion, the elongate body portion comprising a load portion and a truss portion coupled to the load portion;

wherein the truss portion comprises a first strut coupled to the load portion and extending away from the load portion, a first cross beam coupled to the first strut and extending away from the first strut, a second strut extending away from the first cross beam towards the load portion, a third strut extending away from the load portion, a second cross beam coupled to the third strut and extending away from the third strut, a fourth strut coupled to the second cross beam and extending towards the load portion and coupled to the load portion, and a third cross beam coupled to the second strut and the third strut; and wherein the load portion and the truss portion of the elongate body portion are formed as a single piece.

2. The fork according to claim 1, wherein the third cross beam is further coupled to the load portion.

3. The fork according to claim 2, wherein the third cross beam is coupled to the load portion via integral formation with the load portion.

4. The fork according to claim 1, where in each of the first, second, third, and fourth struts are coupled to the load portion.

5. The fork according to claim 1, wherein the load portion comprises a flat surface extending longitudinally away from the toe portion, further comprising:

a stiffener rigidly connected to and extending from the flat surface, wherein the stiffener is sized and located to inhibit longitudinal bending of the body portion.

6. The fork according to claim 1, wherein the truss portion comprises a first truss and a second truss;

wherein the first truss comprises the first strut coupled to the load portion and extending away from the load portion, the first cross beam coupled to the first strut and extending away from the first strut, the second strut extending away from the first cross beam towards the load portion, the third strut extending away from the load portion, the second cross beam coupled to the third strut and extending away from the third strut, and the fourth strut coupled to the second cross beam and extending towards the load portion and coupled to the load portion, and the third cross beam coupled to the second strut and the third strut; and wherein the second truss comprises a fifth strut coupled to the load portion and extending away from the load portion, a fourth cross beam coupled to the fifth strut and extending away from the fifth strut, a sixth strut extending away from the fourth cross beam towards the load portion, a seventh strut extending away from the load portion, a fifth cross beam coupled to the seventh strut and extending away from the seventh strut, and an eighth strut coupled to the fifth cross beam and extending towards the load portion and coupled to the load portion, and a sixth cross beam coupled to the sixth strut and the seventh strut.

7. The fork according to claim 6, wherein the elongate body portion comprises no more than two longitudinal weldments.

8. The fork according to claim 7, wherein one or more longitudinal weldments are positioned to couple:

(a) the load portion and the first strut;
(b) the load portion and the second strut;
(c) the load portion and the third strut;
(d) the load portion and the fourth strut;
(e) the load portion and the fifth strut;
(f) the load portion and the sixth strut;
(g) the load portion and the seventh strut;
(h) the load portion and the eighth strut; or
(i) a combination thereof.

9. The fork according to claim 6, wherein the first truss is spaced apart from the second truss to form a central channel sized and shaped to receive a support wheel linkage mechanism.

10. The fork according to claim 6, wherein:

the third cross beam is coupled to the load portion; and the sixth cross beam is coupled to the load portion.

11. The fork according to claim 6, wherein the load portion comprises a flat surface extending longitudinally away from the toe portion, further comprising:

a stiffener rigidly connected to and extending from the flat surface, wherein the stiffener is sized and located to inhibit longitudinal bending of the body portion.

12. The fork according to claim 1, wherein the load portion comprises a flat surface extending longitudinally away from the toe and a stiffener rigidly connected to the flat surface and parallel to the flat surface; and wherein the stiffener is sized and located to inhibit longitudinal bending of the body.

13. The fork according to claim 12, wherein the stiffener comprises a flute formed in the flat surface.

14. The fork according to claim 13, wherein the flute formed in the flat surface extends towards the truss portion.

15. The fork according to claim 13, wherein the stiffener comprises a plurality of flutes formed in the flat surface.

16. The fork according to claim 1, wherein the elongate body portion comprises no more than two longitudinal weldments.

17. The fork according to claim 1, wherein the second and/or third strut is substantially non-perpendicular with the load portion.

18. The fork according to claim 1, wherein the first strut has a thickness dimension of 5.0 mm or less.

19. The fork according to claim 18, wherein the first strut has a thickness dimension of 4.5 mm or less.

20. A fork for a forklift truck comprising:

a toe portion; and an elongate body portion coupled to the toe portion, the elongate body portion comprising a load portion and a truss portion coupled to the load portion;

wherein the truss portion comprises a first strut coupled to the load portion and extending away from the load portion, a first cross beam coupled to the first strut and extending away from the first strut, a second strut extending away from the first cross beam towards the load portion, a third strut extending away from the load portion, a second cross beam coupled to the third strut and extending away from the third strut, a fourth strut coupled to the second cross beam and extending towards the load portion and coupled to the load portion, and a third cross beam coupled to the second strut and the fourth strut; and wherein the third cross beam is further coupled to the load portion via spot welds.

21. A fork for a forklift truck comprising:

a toe portion; and an elongate body portion coupled to the toe portion, the elongate body portion comprising a load portion and a truss portion coupled to the load portion;

wherein the truss portion comprises a first strut coupled to the load portion and extending away from the load portion, a first cross beam coupled to the first strut and extending away from the first strut, a second strut extending away from the first cross beam towards the load portion, a third strut extending away from the load portion, a second cross beam coupled to the third strut and extending away from the third strut, a fourth strut coupled to the second cross beam and extending towards the load portion and coupled to the load portion, and a third cross beam coupled to the second strut and the fourth strut;

wherein the elongate body portion comprises no more than two longitudinal weldments; and wherein one or more longitudinal weldments are positioned to couple:

(a) the load portion and the first strut;
(b) the load portion and the second strut;
(c) the load portion and the third strut;
(d) the load portion and the fourth strut; or
(e) a combination thereof.

* * * * *